United States Patent [19]

Sauer

[11] Patent Number: 5,019,211

[45] Date of Patent: May 28, 1991

[54] TISSUE WEBS CONTAINING CURLED TEMPERATURE-SENSITIVE BICOMPONENT SYNTHETIC FIBERS

[75] Inventor: Robert D. Sauer, Fremont, Wis.

[73] Assignee: Kimberly-Clark Corporation, Neenah, Wis.

[21] Appl. No.: 256,346

[22] Filed: Oct. 11, 1988

Related U.S. Application Data

[63] Continuation-in-part of Ser. No. 130,710, Dec. 9, 1987, abandoned.

[51] Int. Cl.[5] ..... D21D 3/00

[52] U.S. Cl. ..... 162/111; 162/146; 162/157.1

[58] Field of Search ..... 162/101, 111, 157.1, 162/146, DIG. 1, 204

[56] References Cited

U.S. PATENT DOCUMENTS

| | | | |
|---|---|---|---|
| 3,032,465 | 5/1962 | Selke et al. | 162/146 |
| 3,674,621 | 2/1970 | Miyamoto et al. | 162/146 |
| 3,947,315 | 3/1976 | Smith | 162/101 |
| 4,208,459 | 6/1980 | Becker et al. | 162/111 X |
| 4,488,932 | 12/1984 | Eber et al. | 162/100 X |

*Primary Examiner*—Peter Chin
*Assistant Examiner*—Thi Dang
*Attorney, Agent, or Firm*—Gregory E. Croft

[57] ABSTRACT

Temperature-sensitive bicomponent synthetic fibers that curl when heated are useful for making creped tissue webs with substantially increased bulk and absorbency with relatively low loss of strength.

7 Claims, 2 Drawing Sheets

TISSUE WEBS CONTAINING CURLED TEMPERATURE-SENSITIVE BICOMPONENT SYNTHETIC FIBERS

This application is a continuation-in-part of application Ser. No. 07/130,710 filed Dec. 9, 1987 now abandoned.

BACKGROUND OF THE INVENTION

In the manufacture of tissue products such as facial tissue, bath tissue, and paper towels, efforts are continually directed toward making these products softer and bulkier. Efforts to increase bulk are particularly important for bath tissue and paper towels, where bulk contributes to the perceived absorbency and effectiveness of the product.

Bulk can also play an important role for other paper products as well. For example, considerable work has been done by others on curling cellulose fibers for incorporation into newsprint to alter the web properties. In some instances, depending upon the nature of the cellulose fibers, the bulk of the final product was improved. See "Curl Setting - A Process for Improving the Properties of High-Yield Pulps," M. C. Barbe, R. S. Seth, and D. H. Page, *Pulp and Paper Can.* 85, No. 3: T44–51 (1984).

SUMMARY OF THE INVENTION

It has now been discovered that the bulk and absorbent capacity of creped tissue webs can be greatly enhanced with relatively little loss in strength by incorporating into the web temperature-sensitive bicomponent synthetic fibers that curl upon exposure to heat. Advantageously, these fibers can be straight or only slightly curled during the formation of the web. This situation provides an advantage over formation in the presence of curled cellulose fibers because curled fibers have an adverse effect on web formation or uniformity. However, after the web has been formed and is being dried, the fibers used for this invention curl upon exposure to the drying temperature and thereby dedensify the sheet and increase its bulk. When creped, the bulk and absorbency are increased even more with a loss in strength that is much less than would be expected.

Hence, in one aspect, the invention resides in a creped tissue web comprising cellulosic fibers and curled temperature-sensitive bicomponent synthetic fibers.

In another aspect, the invention resides in a process for making a creped tissue web comprising: wet forming a tissue web from a blend of cellulosic fibers and temperature-sensitive bicomponent synthetic fibers; drying and raising the temperature of the web such that the temperature-sensitive bicomponent synthetic fibers curl and increase the bulk of the web; and creping the dried web. Creping is performed when the web is at least about 90 percent dry, i.e. the web contains about 10 weight percent water or less.

For purposes herein, "creped tissue web" means any web having a dry basis weight of from about 5 to about 40 pounds per 2880 square feet that contains cellulosic papermaking fibers and has been mechanically debonded, such as by the commonly known method of creping by adhering a web to a rotating cylinder and removing the web by contact with a doctor blade. Other methods of mechanical debonding which are included herein as creping methods include "microcreping" and "Clupaking" which are terms well known in the trade. Creped tissue webs include facial tissues, bath tissues, paper towels, and the like.

"Temperature-sensitive bicomponent synthetic fibers" means any synthetic fiber which contains at least two different chemical species that have different thermal properties, i.e. they expand or contract differently when heated beyond a certain elevated temperature. Although multiple chemical species can be present, two are normally sufficient to achieve the desired effect. These fibers preferably have the two different components situated side-by-side as the fiber is viewed in cross-section, but other arrangements, such as coaxial bicomponent fibers, are also suitable. Regardless of the particular arrangement of the two chemical species within the fiber, the distinguishing characteristic of the temperature-sensitive bicomponent synthetic fibers useful for purposes of this invention is that they are temperature-sensitive and thereby curl when sufficiently heated. Temperature-sensitive bicomponent synthetic fibers which have been curled by being heated are herein referred to as "heat-activated."

The terms "curl" or "crimp" as used herein mean a significant distortion of the axis of the fiber in either two or three dimensions. Axial elongation or contraction of the fiber is only a one-dimensional distortion and hence is not curling. There must be some bending of the fiber, preferably three-dimensionally in the nature of a helix, reverse-helix, or a directionally random multiple bending. Those skilled in the papermaking art will recognize a curled fiber as described herein and will be able to distinguish curled fibers from those that are not curled.

Preferably, the different components of the temperature-sensitive bicomponent synthetic fibers react differently to the temperature in such a way that a three-dimensional helical fiber is formed. Some of the fibers may exhibit helix-direction reversals, which further enhance the effect. In a blend with cellulosic or wood pulp fibers, the curling of the bicomponent fiber disrupts the bonding of the total fiber network in such a way as to lower the overall web density by preventing bonding between some cellulosic fibers and possibly breaking weak bonds between others. In the case of creped tissue webs, the increase in bulk and absorbent capacity and relatively low loss of tensile strength is unexpected when compared to creped tissues containing non-heat-sensitive fibers.

Bicomponent synthetic fibers suitable for use in connection with this invention and their methods of manufacture are well known in the polymer field. For example, Hoffman, Jr. U.S. Pat. No. 3,547,763 (1970) discloses a bicomponent fiber having a modified helical crimp. Anton et al. U.S. Pat. No. 3,418,199 (1968) discloses a crimpable bicomponent nylon filament. Bosely U.S. Pat. No. 3,454,460 (1969) discloses a bicomponent polyester textile fiber. Harris et al. U.S. Pat. No. 4,552,603 (1985) discloses a method for making bicomponent fibers comprising a latently adhesive component for forming interfilamentary bonds upon application of heat and subsequent cooling. Zwick et al. U.S. Pat. No. 4,278,634 discloses a melt-spinning method for making bicomponent fibers. All of these patents are hereby incorporated by reference.

The relative amount of temperature-sensitive bicomponent synthetic fibers in the creped tissue web can range from about 5 to about 80 weight percent. Lesser amounts will have a minimal effect on web bulk and greater amounts will severely inhibit or prevent the sheet from holding together since the presence of a sufficient amount of cellulosic fibers is necessary for adequate hydrogen bonding. The synthetic fibers generally do not bond to the other fibers in the web and are held therein primarily by entanglement.

The fiber length of the temperature-sensitive bicomponent synthetic fibers is preferably within the range of 0.5 to about 8 millimeters in length, more preferably from about 1 to about 4 millimeters. The shorter fibers allow better web formation, but the longer fibers provide greater curlation and hence greater bulking ability. These two considerations have to be balanced to achieve the specific properties desired in the final product.

EXAMPLES

Example 1. Handsheets

Figure 1:
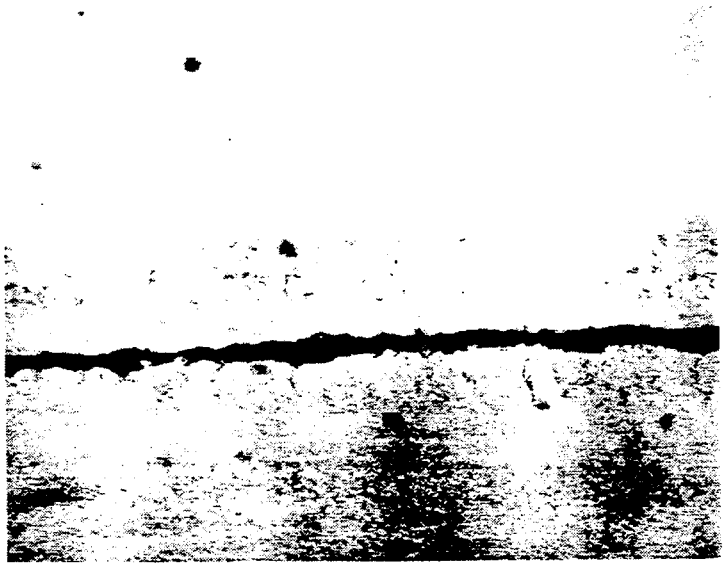
FIG. 1 is a magnified (50×) cross-sectional photomicrograph of a handsheet made with 100 percent conventional cellulosic fibers (northern softwood craft fibers).
Figure 2:
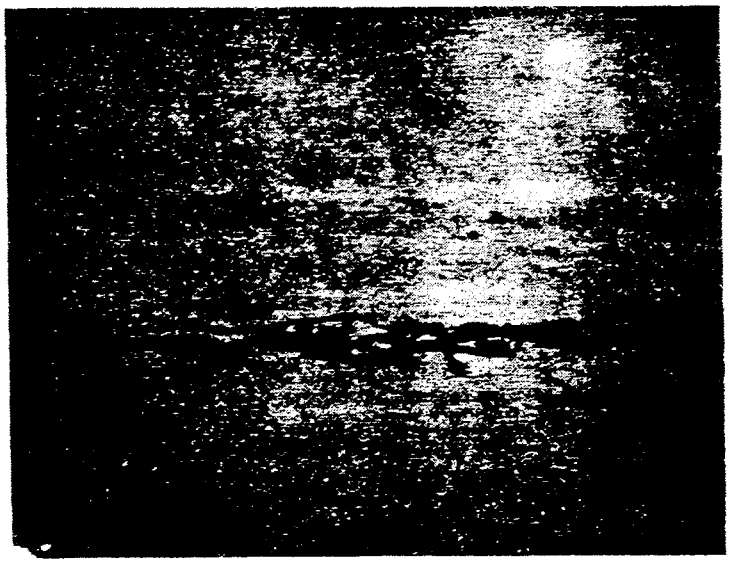
FIG. 2 is a magnified (50×) cross-sectional photomicrograph of a handsheet made with 70 percent conventional cellulosic fibers and 30 percent temperature-sensitive bicomponent acrylic fibers, illustrating the increase in sheet bulk attributable to the heat-activated curled fibers.

In order to illustrate the increase in bulk attainable by making paper using temperature-sensitive bicomponent synthetic fibers, handsheets (11 pounds per 2880 square feet) were prepared with different furnishes in a conventional manner, i.e. a slurry of fibers was deposited onto the wire of the handsheet mold, the water was removed, and the wet web was dried at a temperature of about 212° F. to cause the temperature-sensitive bicomponent synthetic fibers to curl. The furnishes tested contained northern softwood craft fibers and varying levels of temperature-sensitive bicomponent acrylic fibers manufactured by Monsanto Chemical Company under the tradename Acrilan 16. Also tested for comparison were non-curling acrylic fibers of the same denier and fiber length. The resulting sheet was measured for bulk (expressed as $10^{-3}$ inches) using a TMI bulk tester (Model 549-M) in a modified TAPPI procedure T411-68 (using 80 grams per square inch pressure and an anvil diameter of 50.8 millimeters). The temperature-sensitive bicomponent acrylic fibers used for the results set forth in Table 1 had a denier of 6.0 and a fiber length of 6 millimeters. The temperature-sensitive bicomponent acrylic fibers used for the results set forth in Table 2 has a denier of 3.0 and a fiber length of 3.0 millimeters. Both types of temperature-sensitive bicomponent acrylic fibers curled when dried at temperatures of 170° F. or greater. The results are summarized below.

TABLE 1

Handsheet Bulk Comparison (6 millimeter, 6.0 denier)

| Sample | Percent Temperature-Sensitive Bicomponent Acrylic Fibers | Percent Non-Temperature-Sensitive Acrylic Fibers | Bulk |
|---|---|---|---|
| 1* | 0 | 0 | 32 |
| 2 | 5 | 0 | 37 |
| 3 | 10 | 0 | 46 |
| 4 | 20 | 0 | 52 |
| 5 | 30 | 0 | 64 |
| 6 | 80 | | 93 |
| 7 | 0 | 10 | 32 |
| 8 | 0 | 20 | 35 |
| 9 | 0 | 30 | 39 |
| 10 | 0 | 40 | 44 |

TABLE 2

Handsheet Bulk Comparison (3 millimeter, 3.0 denier)

| Sample | Percent Temperature-Sensitive Bicomponent Acrylic Fibers | Bulk |
|---|---|---|
| 1* | 0 | 32 |
| 11 | 10 | 39 |
| 12 | 20 | 47 |
| 13 | 30 | 55 |
| 14 | 40 | 89 |

*100% cellulosic

These results clearly illustrate the unexpectedly large bulk increases associated with varying levels of temperature-sensitive bicomponent synthetic fibers having two different fiber lengths and deniers. Also compared are the bulk increases for varying levels of temperature-sensitive curled bicomponent synthetic fibers relative to non-temperature-sensitive synthetic fibers of the same size.

Example 2. Creped Tissue

In order to illustrate the advantages of temperature-sensitive bicomponent synthetic fibers when used in the making of creped tissue webs, creped tissue webs having a basis weight of 12.5 pounds per 2880 square feet were made in a conventional continuous manner. More specifically, an aqueous slurry of papermaking fibers was deposited onto an endless forming fabric to form a wet web. The wet web was dewatered and dried to a consistency (weight percent solids) of about 25 percent using a combination of vacuum suction boxes and a dewatering felt. The dried web was adhered to a creping cylinder (Yankee dryer) using a polyvinyl alcohol creping adhesive and final dried to a consistency of about 95 percent before being creped by being dislodged from the creping cylinder with a doctor blade. The creped tissue web was wound into a roll for physical testing.

Figure 3:
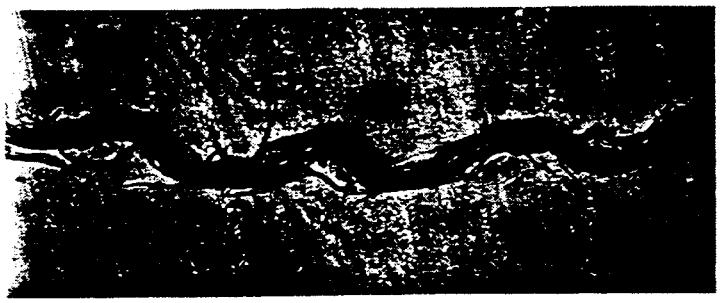
FIG. 3 is a magnified (100×) cross-sectional photomicrograph of a creped tissue containing a 50/50 mixture of hardwood and softwood fibers.
Figure 4:
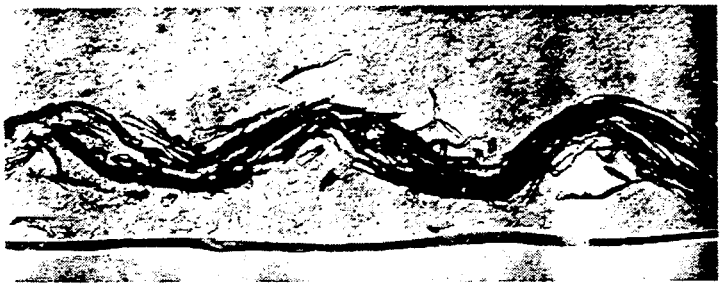
FIG. 4 is a magnified (100×) cross-sectional photomicrograph of a creped tissue containing 15 percent acrylic fibers.
Figure 5:
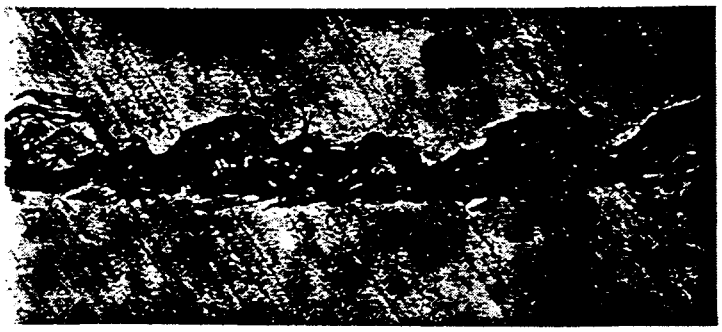
FIG. 5 is a magnified (100×) cross-sectional photomicrograph of a creped tissue of this invention containing 15 percent temperature-sensitive bicomponent synthetic fibers.

Three different tissue webs were made. One was a control sample, containing 50 dry weight percent softwood craft and 50 dry weight percent eucalyptus. A second sample (#2) contained 35 dry weight percent softwood craft, 50 dry weight percent eucalyptus, and 15 dry weight percent non-temperature-sensitive acrylic fibers having a denier of 3.0 and a length of about 3 millimeters. A third sample (#3) contained 35 dry weight percent softwood craft, 50 dry weight percent eucalyptus, and 15 dry weight percent temperature-sensitive bicomponent acrylic fibers having a denier of 3.0 and a length of about 3 millimeters. Cross-sectional photographs of the Control sample, Sample #1, and Sample #2 are shown in FIGS. 3, 4, and 5 respectively.

All three samples were tested for geometric mean tensile strength (GMT) which is equal to $\sqrt{MD \times CD}$, where MD = machine direction tensile strength (grams) and CD = cross-machine direction tensile strength (grams). The samples were also tested for TMI bulk as previously described and absorbent capacity. Absorbent capacity was measured by placing the sample in a water bath at 30° C. and allowing the sample to wet out. The sample was drained for 29±3 seconds and then weighed for the amount of water absorbed. The difference (Δ) relative to the control sample for each property was calculated and reported as a percent change. The results of the testing are summarized in Table 3 below.

TABLE 3

| | Creped Tissue Properties Comparison | | | | | |
|---|---|---|---|---|---|---|
| Sample | GMT (grams) | Bulk (in. × $10^{-3}$) | Absorbent Capacity (grams/gram) | ΔGMT (%) | ΔBulk (%) | Absorbent Capacity (%) |
| Control | 1400 | 58 | 6.8 | — | — | — |
| #2 | 650 | 72 | 7.5 | −54 | +20 | +9.0 |
| #3 | 1000 | 82 | 8.4 | −28 | +30 | +20.0 |

The results illustrate an unexpected increase in bulk and absorbent capacity with approximately one-half of the decrease in tensile strength relative to the conventional synthetic fiber sample. Hence for creped webs, temperature-sensitive bicomponent synthetic fibers can be used to greatly enhance the desirable properties of bulk and absorbency while minimizing the loss in strength associated with more typical synthetic fibers.

It will be appreciated by those skilled in the art that the foregoing examples, shown only for purposes of illustration, are not to be construed as limiting the scope of this invention, which is defined by the following claims.

I claim:

1. A process for making a creped tissue web comprising:

(a) forming a wet web from an aqueous slurry containing a blend of cellulosic fibers and temperature-sensitive bicomponent synthetic fibers;

(b) raising the temperature of the web such that the web is at least partially dried and the temperature-sensitive bicomponent synthetic fibers curl to increase the bulk of the web, said temperature being sufficiently low to avoid melting of the temperature-sensitive bicomponent synthetic fibers and substantial bonding of the temperature-sensitive bicomponent synthetic fibers to other fibers in the web; and (c) creping the web to produce a creped tissue web having sufficient tensile strength for use as facial tissue, bath tissue, or paper towels.

2. The process of claim 1 wherein the temperature-sensitive bicomponent synthetic fibers are acrylic fibers.

3. The process of claim 1 wherein the amount of the temperature-sensitive bicomponent synthetic fibers is from about 5 to about 80 weight percent based on the dry weight of the web.

4. The process of claim 1 wherein the temperature of the web is raised to 170° F. or greater to dry the web and curl the temperature-sensitive bicomponent synthetic fibers.

5. The process of claim 1 wherein the temperature of the web is raised to about 212° F. to dry the web and curl the temperature-sensitive bicomponent synthetic fibers.

6. A process for making a creped tissue web comprising:

(a) forming a wet web from an aqueous slurry containing a blend of cellulosic fibers and from about 5 to about 20 weight percent temperature-sensitive bicomponent acrylic fibers, based on the dry weight of the web;

(b) raising the temperature of the web to about 170° F. or greater to dry the web and curl the temperature-sensitive bicomponent acrylic fibers without causing the temperature-sensitive bicomponent acrylic fibers to melt and bond to other fibers in the web; and (c) creping the web to produce a creped tissue web having sufficient tensile strength for use as facial tissue, bath tissue, or paper towels.

7. The process of claim 6 wherein the temperature of the web is raised to about 212° F. to dry the web and curl the temperature-sensitive bicomponent acrylic fibers.

* * * * *